US011906171B2

(12) United States Patent
Cadima

(10) Patent No.: US 11,906,171 B2
(45) Date of Patent: Feb. 20, 2024

(54) CONTROL SYSTEMS AND METHODS FOR COOKTOP APPLIANCES

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 142 days.

(21) Appl. No.: 17/502,139

(22) Filed: Oct. 15, 2021

(65) Prior Publication Data

US 2023/0116958 A1 Apr. 20, 2023

(51) Int. Cl.

| | |
|---|---|
| ***F24C 3/12*** | (2006.01) |
| ***F23K 5/00*** | (2006.01) |
| ***F23D 14/46*** | (2006.01) |
| ***F23N 1/00*** | (2006.01) |
| ***F23N 5/02*** | (2006.01) |

(52) U.S. Cl.

CPC ..... *F24C 3/126* (2013.01); *F23D 14/46* (2013.01); *F23K 5/005* (2013.01); *F23N 1/002* (2013.01); *F23N 5/022* (2013.01); *F23N 2235/12* (2020.01); *F23N 2241/08* (2020.01)

(58) Field of Classification Search

CPC ..... F24C 3/126; F24D 14/46; F23K 5/005; F23N 1/002

USPC ..... 126/39 G, 39 R, 39 E, 39 N, 39 BA

See application file for complete search history.

(56) References Cited

U.S. PATENT DOCUMENTS

| | | | | |
|---|---|---|---|---|
| 7,255,100 | B2 | 8/2007 | REpper | |
| 9,523,497 | B2 * | 12/2016 | Deng | F23C 1/00 |
| 9,562,686 | B2 | 2/2017 | San Miguel Arenaza | |
| 9,841,191 | B2 * | 12/2017 | Johncock | F23N 1/002 |
| 10,584,871 | B2 | 3/2020 | Biagioli | |
| 10,619,858 | B2 | 4/2020 | Paller | |
| 10,935,250 | B2 | 3/2021 | Querejeta Andueza | |
| 2002/0073985 | A1 | 6/2002 | Leukhardt | |
| 2019/0170360 | A1 * | 6/2019 | Ha | F24C 3/12 |
| 2019/0309954 | A1 | 10/2019 | Querejeta Andueza | |
| 2020/0300507 | A1 | 9/2020 | Cowan | |
| 2020/0408413 | A1 | 12/2020 | Billman | |

FOREIGN PATENT DOCUMENTS

| | | | |
|---|---|---|---|
| CN | 201241956 | Y | 5/2009 |
| CN | 106871168 | B | 9/2020 |
| CN | 111692408 | A | 9/2020 |
| JP | H10246424 | A | 9/1998 |
| WO | WO2020008088 | A2 | 1/2020 |

* cited by examiner

*Primary Examiner* — Vivek K Shirsat

(74) *Attorney, Agent, or Firm* — Dority & Manning, P.A.

(57) ABSTRACT

Cooktop appliances are provided. A cooktop appliance can include a gas burner; a manifold having a gas input; a primary line extending between the manifold and the gas burner, wherein a gas flow rate in the primary line is controllable by a user selectable interface; and a secondary line extending between the manifold and the gas burner, wherein a gas flow rate in the secondary line is controllable by a flow control valve.

19 Claims, 9 Drawing Sheets

CONTROL SYSTEMS AND METHODS FOR COOKTOP APPLIANCES

FIELD

The present disclosure relates generally to cooktop appliances, and more particularly to gas cooktop appliances.

BACKGROUND

Temperature control in stove tops was traditionally done by an operator adjusting a relative position of a knob associated with the stove top. Over time, more precision temperature control was introduced whereby the stove top actively regulated temperature using precision flow control valves. However, these systems often suffer from long term drift and limited accuracy at the lowest as flow rates which are used for simmering functions. Moreover, these systems are expensive and require highly precise metering devices which limit general applicability.

Accordingly, improved cooking appliances are desired in the art. In particular, cooking appliances which provide relatively inexpensive solutions to temperature control without suffering from long term drift and limited accuracy would be advantageous.

BRIEF DESCRIPTION

Aspects and advantages of the invention in accordance with the present disclosure will be set forth in part in the following description, or may be obvious from the description, or may be learned through practice of the technology.

In accordance with one embodiment, a cooktop appliance is provided. The cooktop appliance includes a gas burner; a manifold having a gas input; a primary line extending between the manifold and the gas burner, wherein a gas flow rate in the primary line is controllable by a user selectable interface; and a secondary line extending between the manifold and the gas burner, wherein a gas flow rate in the secondary line is controllable by a flow control valve.

In accordance with another embodiment, a cooktop appliance is provided. The cooktop appliance is configured to operate in a manual mode whereby a gas flow rate to a gas burner is controlled by a user selectable interface and an automatic mode whereby a gas flow rate to the gas burner is controlled by a flow control valve, and wherein the cooktop appliance is reconfigurable between different gas types by adjusting a single adjustment point.

In accordance with one embodiment, a method of using a cooktop appliance is provided. The method includes operating the cooktop appliance in a manual mode, wherein in the manual mode a gas is supplied to a gas burner of the cooktop appliance through a primary line; adjusting the cooktop appliance to an automatic mode; in response to being adjusted to the automatic mode, the cooktop appliance: adjusting the primary line to be a non-modulated, minimum gas flow line; and actively modulating a flow control valve on a secondary line in communication with the gas burner.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
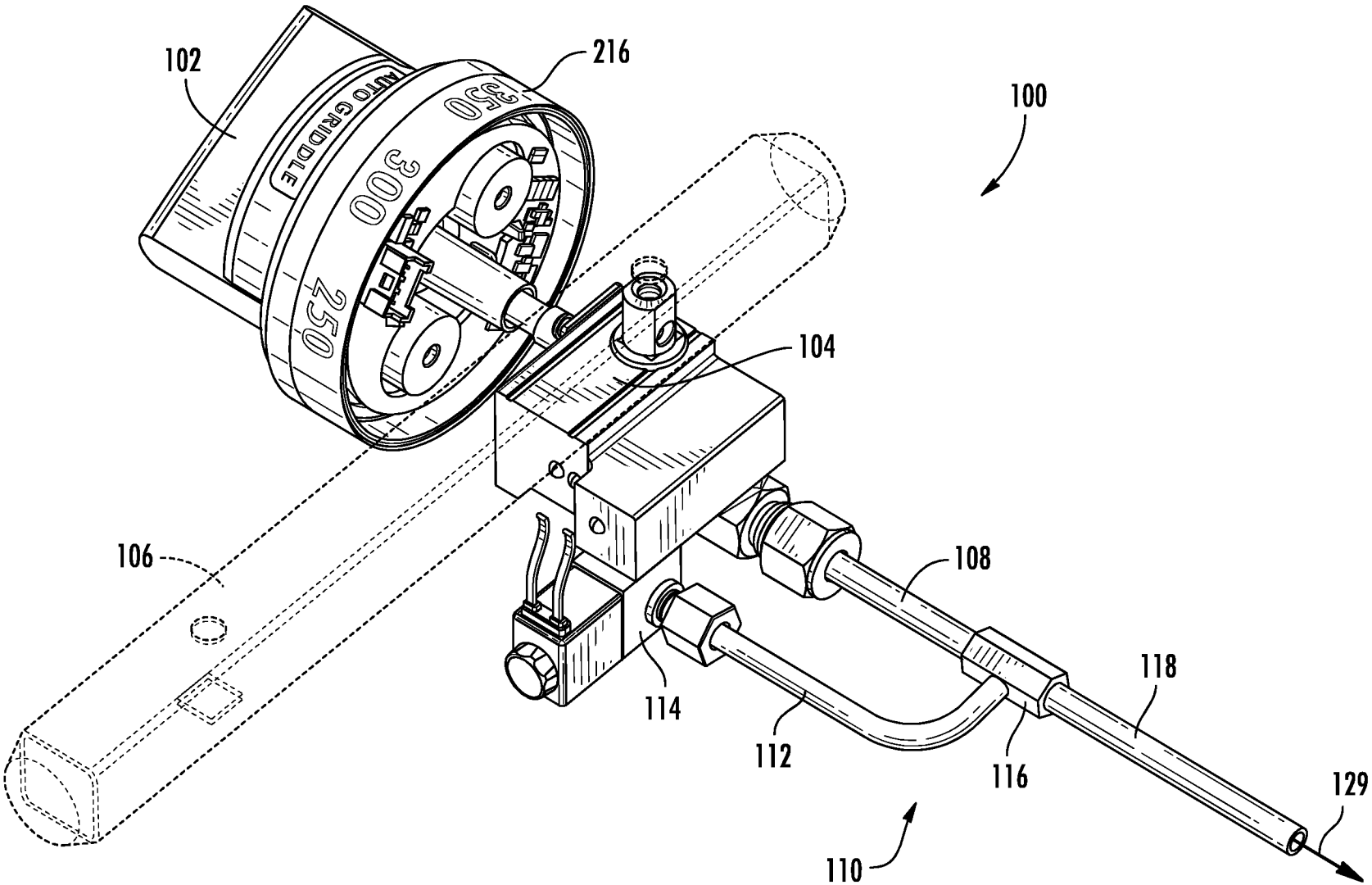
FIG. 1 is a partially transparent perspective rear view of a portion of a control assembly for regulating gas flow in a cooktop appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

In general, cooktop appliances described herein may be gas cooktop appliances which can be switchable between automatic and manual operating modes. In manual operating mode, the operator can manually adjust flame height at a gas burner of the cooktop appliance. In automatic operating mode, the cooktop appliance, and more particularly a control system of the cooktop appliance, can control temperature at the gas burner. More particularly, the cooktop appliance can control temperature at cooking hardware being heated by the cooktop appliance when in automatic operating mode. In this regard, the cooktop appliance can control and maintain precise temperature at the cooking hardware.

Figure 2:
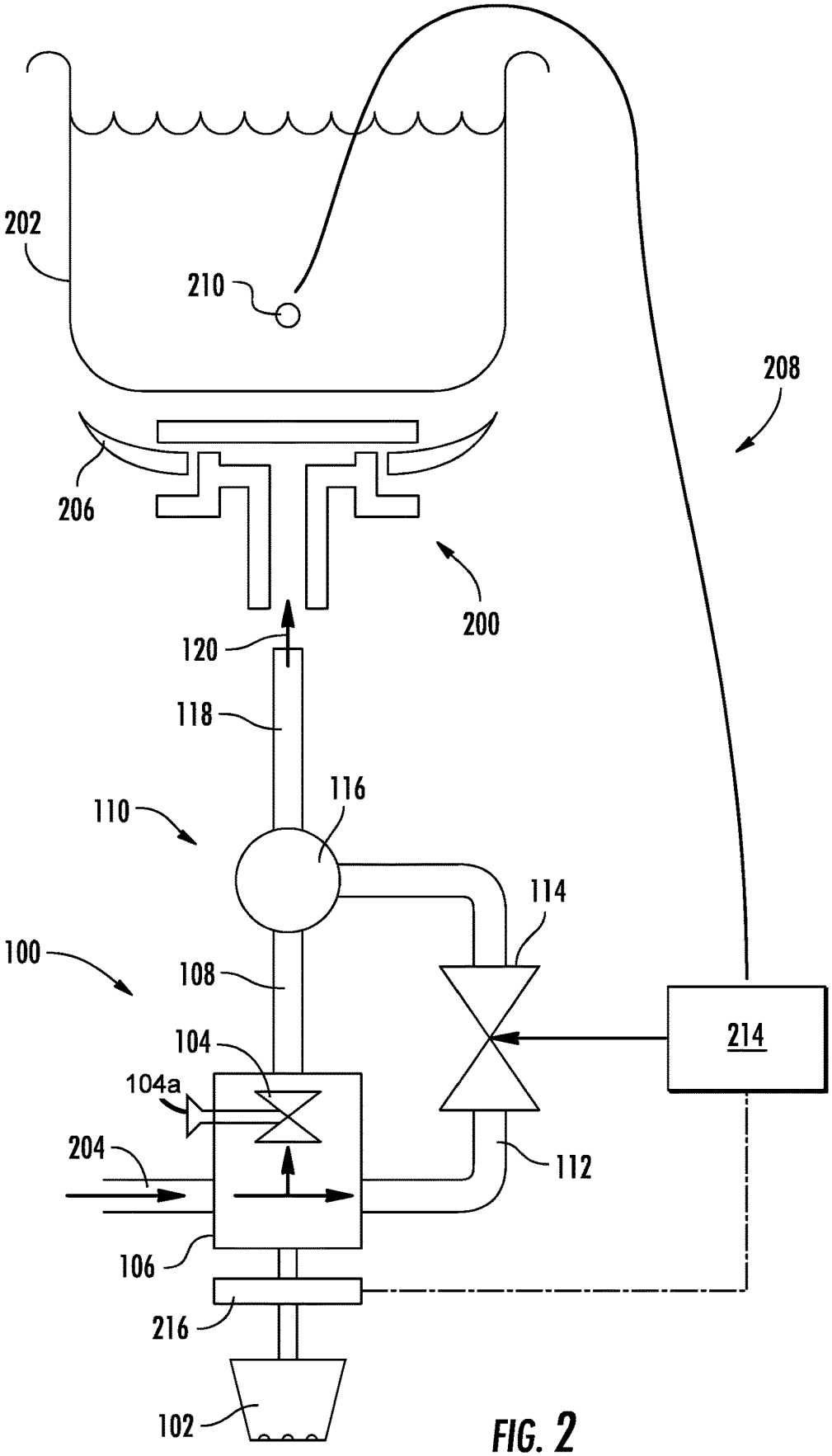
FIG. 2 is a schematic view of the control assembly of FIG. 1 in accordance with embodiments of the present disclosure.

Referring now to the drawings, FIG. 1 illustrates a partially transparent perspective rear view of a portion of a control assembly 100 for regulating gas flow in a cooktop appliance (not illustrated). FIG. 2 illustrates a schematic view of the control assembly 100. The cooktop appliance can include a gas stovetop having one or more gas burners 200 (FIG. 2) that receive and selectively heat cooking hardware 202, such as pots and pans. Each gas burner 200 may be controlled by a separate control assembly 100, allowing an operator to selectively control the temperature of each gas burner 200 individually.

In accordance with embodiments described herein, at least one of the gas burners 200 may be selectively adjustable between various modes. For instance, the at least one gas burner 200 may be selectively adjustable between a manual operating mode and an automatic operating mode. In the manual operating mode, the operator can adjust a heat level supplied to the cooking hardware 202 by manually changing a characteristic of the control assembly 100. In the automatic operating mode, the control assembly 100 can automatically maintain the temperature at the cooking hardware 202 at a desired temperature.

The control assembly 100 can include a knob 102. The knob 102 may be rotatable about an axis. As the knob 102 is rotated through a rotational range corresponding to the manual operating mode, the gas burner 200 associated with the knob 102 changes between a low setting and a high setting. For instance, as the knob 102 is rotated clockwise, the flame increases. Conversely, as the knob 102 is rotated counterclockwise, the flame decreases. The inverse arrangement is also possible. The operator can set the desired temperature (or at least a flame size at the gas burner 200) by turning the knob 102 to a desired rotational position. In a non-illustrated embodiment, the knob 102 may include a different user interface, such as a digital display, a switch, dial, slider, or the like. The operator can affect temperature at the gas burner 200 by manually adjusting the user interface.

In an embodiment, automatic operating mode can be selected at the knob 102. For instance, the knob can have a range of rotational positions associated with the manual operating mode and at least one position associated with the automatic operating mode. By rotating the knob 102 to the position(s) associated with the automatic operating mode, the control assembly 100 may automatically control the gas burner 200, e.g., a flame thereof, and thus the temperature at the cooking hardware 202. It is noted that in accordance with one or more embodiments, the automatic operating mode does not require the knob 102 be set such that a gas flow path to the gas burner 200 is at a maximum open position. That is, as described in greater detail below, use of the automatic operating mode does not require the knob 102 be opened to a maximum open position.

In an embodiment, automatic operating mode may be selectable through a secondary interface (not illustrated) other than the knob 102. For instance, the operator may initiate automatic operating mode through use of a secondary switch, dial, button, or the like.

The knob 102 may be coupled to a valve (e.g., primary valve 104) which can control gas flow from a manifold 106 receiving gas from a gas input 204. The valve 104 may be a manual valve controlled by a relative angular position of the knob 102. With the valve 104 in the fully open position and the control assembly 100 in manual operating mode, gas can flow at a maximum flow rate to the gas burner 200. With the valve 104 in the closed position in manual operating mode, gas may not flow to the gas burner 200. In certain instances, the manifold 106 may supply gas flow to one or more other control assemblies 100 which may be tapped into or connected with the manifold 106. These one or more other control assemblies 100 may supply gas to other gas burner (s) that are not shown.

In manual operating mode, the valve 104 may be selectively adjusted between the fully open and fully closed positions, or between any two or more locations therebetween, to modulate gas flow to the gas burner 200. In a particular embodiment, the valve 104 may be infinitely adjustable between the fully open and fully closed positions. That is, the valve 104 may not include discrete stop locations but rather be openable to any relative angular position between the fully open and fully closed positions. By rotating the knob 102, the operator can effectively control the valve 104 so as to modulate gas flow to the gas burner 200.

Gas flowing to the gas burner 200 can pass from the manifold 106 through the valve 104 into a primary line 108 of a gas burner supply line 110 supplying the gas burner 200. As the gas flow is modulated by the operator at the knob 102, a volumetric flow rate of gas through the primary line 108 to the gas burner 200 changes, thus allowing the operator to modulate the heat supplied at the gas burner 200. When operating in manual operating mode, the gas burner 200 may be controlled only by gas flowing through the primary line 108.

The gas burner supply line 110 can further include a secondary line 112. Use of terms primary and secondary as reference to the primary and secondary lines 108 and 112 is done for purpose of clarity and does not represent any associated criticality or order of function. The secondary line 112 may operate in parallel with the primary line 108. In manual operating mode, the secondary line 112 of the gas burner supply line 110 is closed to prevent gas from passing through the secondary line 112. In this regard, manual operating mode may use only the primary line 108.

The secondary line 112 is in fluid communication with a valve 114 (which can be referred to as a flow control valve) which controls gas flow through the secondary line 112. The valve 114 may be an electronic valve (also referred to as an e-valve) or include one or more non-manually controlled features. When the control assembly 100 is operating in manual operating mode, the valve 114 may be closed such that all gas flow to the gas burner 200 passes through the primary line 108. When the control assembly 100 is operating in the automatic operating mode, the valve 114 may be selectively adjusted to modulate gas flow to the gas burner 200.

The primary and secondary lines 108 and 112 may be joined together at a junction 116. The junction 116 may be located downstream of the primary and secondary lines 108 and 112. The junction 116 may be in fluid communication with a sum line 118 which can extend from the junction 116 to the gas burner 200 in the direction shown by arrow 120. It should be understood that in certain instances the sum line 118 may be the part of the primary line 108 or the secondary line 112 with the other of the primary line 108 or secondary line 112 tapped thereinto. That is, in certain embodiments the sum line 118 does not need to be separate, discrete line different from both of the primary and secondary lines 108 and 112.

In certain instances, the sum line 118 may extend an entire distance between the junction 116 and the gas burner 200. That is, the sum line 118 may be coupled directly with the gas burner 200. In other instances, one or more secondary gas lines (not illustrated) may be disposed between the sum line 118 and the gas burner 200. In manual operating mode, gas flow through the sum line 118 may originate from the primary line 108 and be controlled by the valve 104 through use of the knob 102. In automatic operating mode, gas flow through the sum line 118 may originate from both the primary line 108 and the secondary line 112 and be controlled by at least the valve 114 in a manner as described in greater detail below.

Referring to FIG. 2, cooking hardware 202 may be selectively disposed at the gas burner 200 during cooking operations. For instance, the cooking hardware 202 may be selectively disposed on a grate or other similar support surface such that the cooking hardware 202 is above, or generally above, a flame 206 emitted from the gas burner 200. In this regard, the cooking hardware 202 may be heated by the gas burner 200.

The control assembly 100 can include a control system 208 for automatically controlling temperature at the cooking hardware 202 through regulating the gas flow rate to the gas burner 200. In an embodiment, the control system 208 can be at least partially integrated into the control assembly 100, the cooking hardware 202, or both. In an embodiment, the cooking hardware 202 may include one or more sensors 210 (e.g., temperature sensors) that sense a temperature corresponding to the gas burner 200. For instance, sensors 210 may be configured to sense or detect a temperature of the cooking hardware 202, a substance (e.g., food) disposed in the cooking hardware 202, or the gas burner 200 itself, as would be understood. In certain instances, the sensor(s) 210 may be integrated into the cooking hardware 202, such as at least partially embedded therein. In the depicted embodiment, the sensor 210 is removably disposed within a fluid 212 being heated by the gas burner 200. For instance, the sensor 210 may include a removable sensor that can be selectively disposed in, or at, the cooking hardware 202. In certain embodiments, the sensor(s) 210 may sense a temperature emitted by the gas burner 200.

Generally, the sensor(s) 210 may or be provided as any suitable temperature-detecting sensor configured to transmit a signal or voltage corresponding to a detected temperature, such as a thermistor, thermocouple, optical sensor, etc. The sensor(s) 210 may be coupled with a controller 214 of the control system 208. In an embodiment, the controller 214 can include a logic device (i.e., processor) and a memory device. In certain instances, the controller 214 can be part of the cooktop appliance. In other instances, the controller 214 can be a remote device, such as a smart device (e.g., a smart phone or tablet). The sensor(s) 210 may be coupled with the controller 214 through a wired interface, a wireless interface, or a combination thereof. In the depicted embodiment, the sensor 210 is coupled with the controller 214 through a wired interface.

In certain instances, the sensor(s) 210 may communicate with the controller 214 to inform the controller 214 whether the cooking hardware 202 is present at the gas burner 200. Use of the controller 214 to control the gas burner 200 may change based on whether cooking hardware 202 is detected. For instance, the controller 214 may not allow for use of automatic operating mode when the cooking hardware 202 is not present. Conversely, the controller 214 may allow for use of the automatic operating mode when the cooking hardware 202 is detected as being present. Thus, the controller 214 may be configured to detect or confirm the presence of cooking hardware 202, as would be understood.

In certain instances, the closed loop temperature control provided by the controller 214 may only be used when certain, prescribed cooking hardware 202 is present. That is, the cooking appliance may only allow for use of the automatic operating mode when approved cooking hardware 202 is present. Approved cooking hardware 202 may have integrated sensor(s) 210 that are configured to operate with the controller 214. In certain instances, cooking hardware lacking integrated sensor(s) 210 may not be used with the cooking appliance in automatic operating mode.

In certain cooking applications, such as for example during sous vide cooking, precise temperature control is required over prolonged durations of time. By way of example, sous vide cooking requires the application of low levels of heat (e.g., 130 to 160 degrees Fahrenheit) over the course of several hours (e.g., one or more hours, such as two or more hours, such as three or more hours, etc.). Even small temperature variations over the duration of the cooking operation can result in drastically different cooking outcomes. In sous vide, food being cooked is typically sealed in a liquid-proof bag and submerged in liquid. The liquid is maintained at a desired temperature, allowing the food to cook at that temperature. Thus, it is necessary to maintain the liquid at a precise temperature to achieve a desired result.

To provide such precision, the control assembly 100 may utilize the control system 208 which can operate in closed loop. By way of example, the sensor(s) 210 can detect the actual temperature of the liquid, the cooking hardware 202, the substance being cooked, the like, or any combination thereof. The sensed temperature can be communicated to the controller 214 which can adjust the valve 114 in response thereto. By modulating the valve 114, the secondary line 112 can have variable gas flow to the junction 116 and sum line 118. As a result, the height of the flame at the gas burner 200 can be controlled and modulated to maintain the actual temperature within an acceptable tolerance.

An input 216 may correspond to a desired temperature and can allow the operator to communicate the desired temperature to the controller 214. By way of example, the input 216 can include a rotatable dial, a knob, a digital interface, or the like. In a particular embodiment, the input 216 can include a dial that is coaxially rotatable with the knob 102. By adjusting the input 216, the operator can effectively set the temperature for the cooking operation without requiring the operator to manually modulate the gas flow using the knob 102. In this regard, gas flow to the gas burner 200 may be controlled to achieve a precise temperature.

When operating in automatic operating mode, the primary line 108 may operate as a non-modulated, minimum gas flow line. That is, the primary line 108 may not be modulated in automatic operating mode and may be set to a minimum gas flow rate. The gas flow rate at the minimum gas flow rate may be controlled by adjusting the valve 104. More particularly, the minimum gas flow rate may be controlled by adjusting an adjustment point (not illustrated) of the valve 104. By way of non-limiting example, the adjustment point may include an orifice (jet), adjustable screw, or the like. Prior to use, the operator (or an installation technician) can adjust the adjustment point of the valve 104 so that the primary line 108 (in a lowest setting) provides a desired minimum gas flow rate. By adjusting open a screw 104*a*, the minimum gas flow rate may be increased. Conversely, by adjusting down a screw, the minimum gas flow rate may be decreased. Similarly, the installation technician may exchange an orifice to limit the minimum as flow rate.

When operating in automatic operating mode, the secondary line 112 may operate as a modulated gas flow line. That is, gas flow rate supplied to the gas burner 200 may be controlled by modulating gas flow through the valve 114. The valve 114 can modulate gas flow through the secondary line 112. Thus, gas flow through the sum line 118 may vary between the minimum gas flow rate provided by the primary line 108 (i.e., when the valve 114 is closed) and a maximum gas flow rate provided by the minimum gas flow rate through primary line 108 in combination with the maximum gas flow rate through the secondary line 112 when the valve 114 is fully open. Since the valve 114 is controlled by the controller 214 (i.e., the relative position of the valve 114 is adjusted by the controller 214), the controller 214 can modulate the gas flow to any flow rate between the minimum and maximum gas flow rates. Thus, the controller 214 can affect temperature at the cooking hardware 202 between a minimum temperature and a maximum temperature. Since the controller 214 can operate in closed loop (i.e., receive temperature information from the sensor(s) 210 and adjust the valve 114 in response thereto), the controller 214 can effectively adjust the gas flow rate to maintain the temperature at the cooking hardware 202 at the desired temperature provided at the input 216.

Cooking appliances may be used with different fuel types. For example, the cooking appliance may be compatible with both propane (LP) and natural gas (NG). When using multiple gas flow lines to supply a gas burner of a traditional cooking appliance, it is necessary to adjust multiple adjustment points to correspond with the selected fuel type. That is, each gas flow line often has its own adjustment point. To switch between fuel types, adjustment points for each gas flow line must be adjusted. This is the result of the fuel types requiring different volumetric flow rates to achieve similar heating characteristics. To accommodate these different flow rates, valves contained in traditional cooking appliances need to be set or jets/orifices must be changed. This conversion between fuel types thus requires additional operator time and if left undone can result in, for example, improper operation of to the appliance.

In accordance with one or more embodiments described herein, the cooktop appliance can advantageously be reconfigurable between different fuel types (i.e., different gas types) by adjusting only a single adjustment point. The single adjustment point may include a single adjustment screw 104*a*. The screw 104*a* may be adjusted in a first direction to restrict gas flow and adjusted in a second direction to increase gas flow. The single adjustment screw 104*a* can be disposed at the valve 104 and control gas flow rate through the primary line 108. In this regard, the secondary line 112 does not need an adjustment point as the valve 114 operates in response to the closed loop temperature control provided by the control system 208.

It is noted that using systems and methods described herein, the operator can access the automatic operating mode without requiring the operator to set the knob 102 (and thus the valve 104) to a fully open position. That is, since the primary line 108 operates at a minimum gas flow rate when the automatic operating mode is selected, the knob 102 does not need to be set to its highest setting. To the contrary, any traditional method of controlling temperature necessarily requires any primary line to be fully open and modulated from a fully open position as any modulation occurs within the primary line (i.e., in series) and thus to achieve a maximum gas flow rate during automatic operations, the valve must be fully open from the start. Consequently, use of a fully open valve requires a difficult method of automatically modulating a minimum flow. Furthermore, initiating an automatic mode with a fully open valve can incur excessive and unnecessary heating of a cooking utensil or the surrounding environment.

Figure 3:
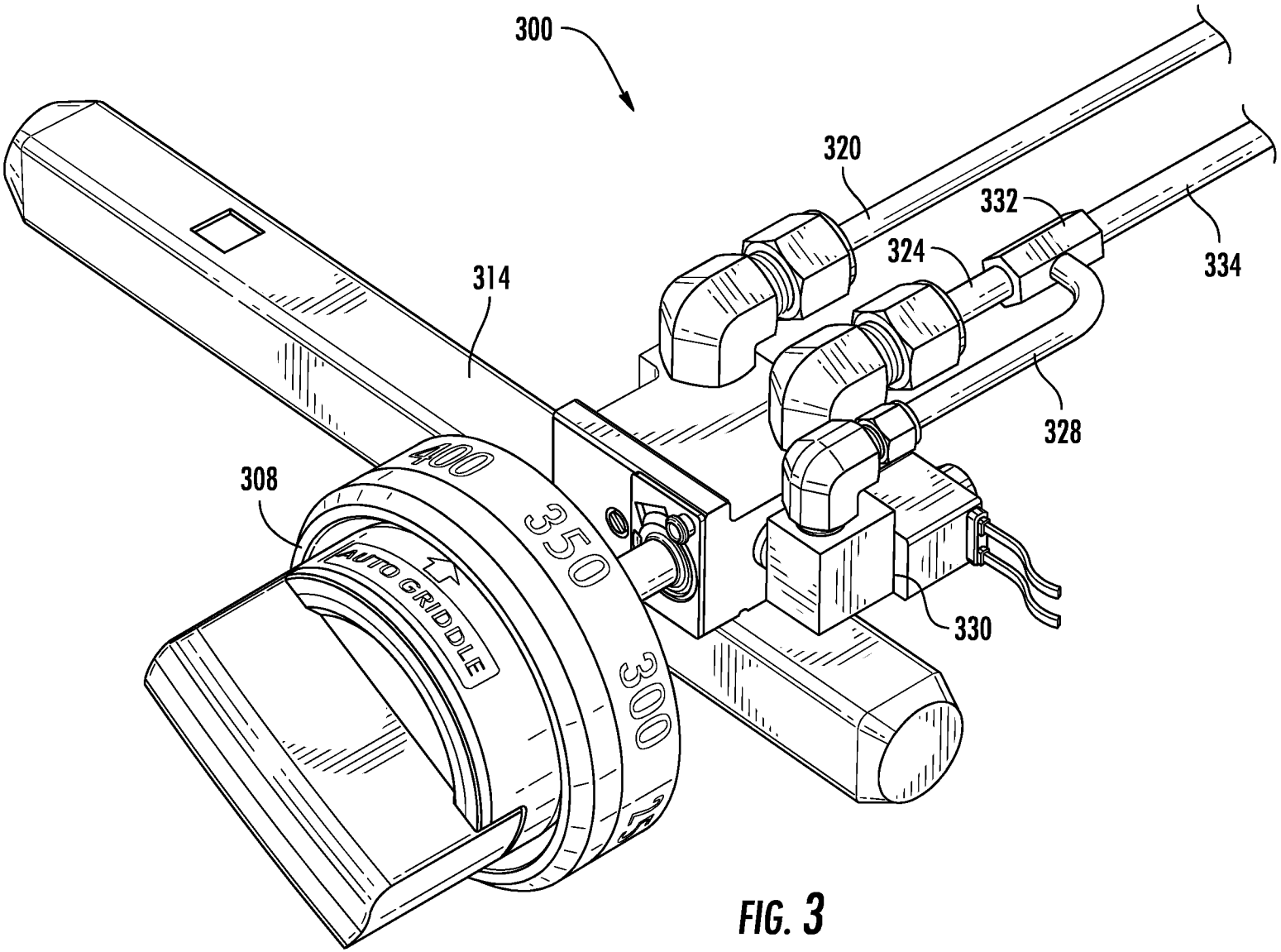
FIG. 3 is a perspective front view of a portion of a control assembly for regulating gas flow in a cooktop appliance in accordance with embodiments of the present disclosure.
Figure 4:
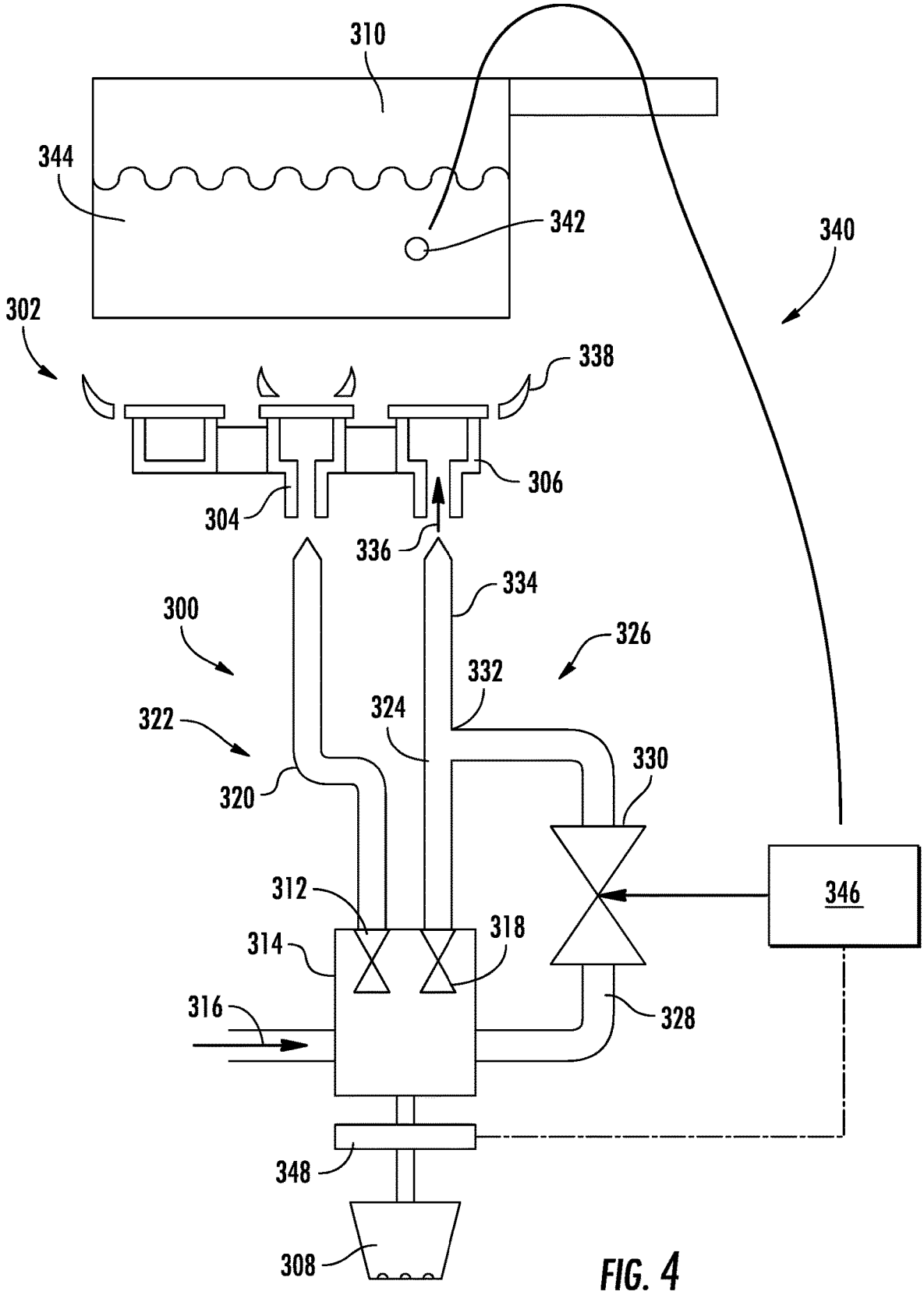
FIG. 4 is a schematic view of the control assembly of FIG. 3 in accordance with embodiments of the present disclosure.

FIG. 3 illustrates a perspective front view of a portion of a control assembly 300 for regulating gas flow in a cooktop appliance (not illustrated). FIG. 4 illustrates a schematic view of the control assembly 300. Unlike the control assembly 100 depicted in FIGS. 1 and 2 which is for a single gas burner 200, the control assembly 300 depicted in FIGS. 3 and 4 is for a multi-burner gas burner 302 (FIG. 4) including a first gas burner 304 and a second gas burner 306. In an embodiment, the first gas burner 304 is a central burner and the second gas burner 306 is an outer burner that extends around at least a portion of a circumference of the first gas burner 304. In some such embodiments, second gas burner 306 may be arranged coaxially with respect to first gas burner 304. In further embodiments, second gas burner 306 is concentric with first gas burner 304. The first and second gas burners 304 and 306 can be in proximity to one another such that the flame from either of the first or second gas burners 304 or 306 can ignite gas passing through the other of the first or second gas burner 304 or 306 when the other of the first or second gas burner 304 or 306 is not actively ignited. In this regard, it may be possible to light the other of the first or second gas burner 304 or 306 without use of a spark generator.

The control assembly 300 may include any one or more of the features as described above with respect to the control assembly 100. The control assembly 300 may also differ from the control assembly 100 in one or more ways. It should be understood that features of the control assembly 100 described herein may be applicable to the control assembly 300 without being explicitly described with respect to the control assembly 300, and vice versa.

Referring initially to FIG. 3, the control assembly 300 can include a knob 308. The knob 308 may be rotatable about an axis. As the knob 308 is rotated through the manual operating mode, the gas burner 302 associated with the knob 308 changes between a low setting and a high setting. For instance, as the knob 308 is rotated clockwise, the flame increases. Conversely, as the knob 308 is rotated counter-clockwise, the flame decreases. The inverse arrangement is also possible, as would be understood in light of the present disclosure. The operator can set the desired temperature (or at least a flame size at the gas burner 302) by turning the knob 308 to a desired rotational position. In a non-illustrated embodiment, the knob 308 may include a different user interface, such as a digital display, a switch, dial, slider, or the like. The operator can affect temperature at the gas burner 302 by adjusting the user interface.

In an embodiment, automatic operating mode can be selected at the knob 308. For instance, the knob can have a range of rotational positions associated with the manual operating mode and at least one position associated with the automatic operating mode. Within the rotational positions associated with the manual mode, there may be a first range of rotational positions associated with single burner use and a second range of rotational positions associated with multi-burner use. In the first range of rotational positions, temperature control may occur through modulation of the first gas burner 304. In the second range of rotational positions, temperature control may occur through modulation of the second gas burner 306 alone or in combination with the first gas burner 304. By rotating the knob 308 to the position(s) associated with the automatic operating mode, the control assembly 300 may automatically control the gas burner 302, e.g., a flame thereof, and thus the temperature at a cooking hardware 310 disposed thereon.

In another embodiment, automatic operating mode may be selectable through a secondary interface (not illustrated) other than the knob 308. For instance, the operator may initiate automatic operating mode through use of a secondary switch, dial, button, or the like.

The knob 308 may be coupled to a valve (e.g., primary valve 312) which controls gas flow from a manifold 314 receiving gas from a gas input 316. The valve 312 may be a manual valve controlled by a relative angular position of the knob 308. The knob 308 may also be coupled to a valve (e.g., primary valve 318) which controls gas flow from the manifold 314. The valve 318 may be a manual valve controlled by the relative angular position of the knob 308. The valves 312 and 318 can be in fluid communication with the first and second gas burners 304 and 306. In the depicted embodiment, the valve 312 supplies gas to the first gas burner 304 and the valve 318 supplies gas to the second gas burner 306. As previously described, the rotational position of the knob 308 can determine whether each of the valves 312 and 318 is open or closed and, if open, to what extent the valve 312 or 318 is open. When the knob 308 is in certain rotational positions the valve 312 is open and the valve 318 is closed. In other rotational positions, both of the valves 312 and 318 may be open.

With both of the valves 312 and 318 in the open position (e.g., a maximum open position), gas can flow to the gas burner 302 at a maximum flow rate. With both of the valves 312 and 318 in the closed position, gas may not flow to the gas burners 302. While not wishing to be bound to any particular mode of operation, in certain embodiments, the valve 318 is only opened when the valve 312 is already open. That is, use of the second gas burner 306 only occurs when the first gas burner 304 is already in use.

In an embodiment, the manifold 314 may supply gas flow to one or more other control assemblies 300 which may be tapped into the manifold 314. These one or more other control assemblies 300 may supply gas to other gas burner (s) that are not shown.

In manual operating mode, the valves 312 and 318 may be selectively adjusted between the fully open and fully closed positions, or between any two or more locations therebetween, to modulate gas flow to the gas burners 302. By rotating the knob 308, the operator can effectively control the valves 312 and 318 so as to modulate gas flow.

Gas flowing to the first gas burner 304 can pass from the manifold 314 through the valve 312 into a primary line 320 of a first gas burner supply line 322 supplying the first gas burner 304. As the gas flow is modulated by the operator at the knob 308, a volumetric flow rate of gas through the primary line 320 to the first gas burner 304 changes, thus allowing the operator to modulate the heat supplied at the first gas burner 304.

Similarly, gas flowing to the second gas burner 306 can pass from the manifold 314 through the valve 318 into a primary line 324 of a second gas burner supply line 326 supplying the second gas burner 306. As the gas flow is modulated by the operator at the knob 308, a volumetric flow rate of gas through the primary line 324 to the second gas burner 306 changes, thus allowing the operator to modulate the heat supplied at the second gas burner 306.

The second gas burner supply line 326 is illustrated as including a secondary line 328. Use of terms primary and secondary as reference to the primary and secondary lines 324 and 328 is done for purpose of clarity and does not represent any associated criticality or order of function. The secondary line 328 may operate in parallel with the primary line 324. In manual operating mode, the secondary line 328 of the second gas burner supply line 326 is closed to prevent gas from passing through the secondary line 328. The secondary line 328 is in fluid communication with a valve 330 (which can be referred to as a flow control valve) which controls gas flow through the secondary line 328. When the control assembly 300 is operating in manual mode, the valve 330 may be closed such that all gas flow to the second gas burner 306 passes through the primary line 324. The valve 330 may be an electronic valve (also referred to as an e-valve), or include one or more non-manually controlled features.

The primary and secondary lines 324 and 326 of the second gas burner supply line 326 may be joined together at a junction 332. The junction 332 may be located downstream of the primary and secondary lines 324 and 326. The junction 332 may be in fluid communication with a sum line 334 which can extend from the junction 332 to the second gas burner 306 in the direction shown by arrow 336. In certain instances, the sum line 334 may extend an entire distance between the junction 332 and the second gas burner 306. That is, the sum line 334 may be coupled directly with the second gas burner 306. In other instances, one or more secondary gas lines (not illustrated) may be disposed between the sum line 334 and the second gas burner 306. In manual operating mode, gas flow through the sum line 334 may originate from the primary line 324 and be controlled by the valve 318 through the knob 308. In automatic operating mode, gas flow through the sum line 334 may originate from both the primary line 324 and the secondary line 328 and be controlled by at least the valve 330 as described in greater detail below.

Similar to the embodiment depicted in FIGS. 1 and 2, the cooking hardware 310 may be selectively disposed at the gas burner 302. For instance, the cooking hardware 310 may be selectively disposed on a grate or other similar support surface such that the cooking hardware 310 is above, or generally above, a flame 338 emitted from the gas burner 302. In this regard, the cooking hardware 310 may be heated by the gas burner 302.

The control assembly 300 can include a control system 340 for automatically controlling a temperature of the cooking hardware 310 through regulating the gas flow rate to the gas burners 302. The control system 340 can be at least partially integrated into the control assembly 300, the cooking hardware 310, or both. In an embodiment, the cooking hardware 310 may include one or more sensors 342 configured to sense a temperature of the cooking hardware 310, a substance (e.g., food) disposed in the cooking hardware 310, or the gas burners 302, as would be understood. In certain instances, the sensor(s) 342 may be integrated into the cooking hardware 310, such as at least partially embedded therein. In the depicted embodiment, the sensor 342 is removably disposed within a fluid 344 being heated by the gas burners 302.

The sensor(s) 342 may be coupled with a controller 346. For example, the sensor(s) 342 may be coupled with the controller 346 through a wired interface, a wireless interface, or a combination thereof. In the depicted embodiment, the sensor 342 is coupled with the controller 346 through a wired interface.

In certain instances, the sensor(s) 342 may communicate to the controller 346 to inform the controller 246 whether the cooking hardware 310 is present at the gas burners 302. Use of the controller 346 to control the gas burners 302 may change based on whether cooking hardware 310 is detected. For instance, the controller 346 may not allow for use of the automatic operating mode when the cooking hardware 310 is not present. Conversely, the controller 346 may allow for use of the automatic operating mode when the cooking hardware 310 is detected as being present.

The closed loop temperature control provided by the controller 346 may only be used when certain cooking hardware 310 is present. That is, the cooking appliance may only allow for use of the automatic operating mode when approved cooking hardware 310 is present. Approved cooking hardware 310 may generally correspond with cooking hardware 310 having integrated sensor(s) 342. Other cooking hardware 310 (i.e., cooking hardware 310 lacking integrated sensor(s) 342) may not be used with the automatic operating mode.

To provide precise temperature control, the control assembly 300 may utilize the control system 340 which can operate in closed loop. The sensor(s) 342 can detect the temperature of the liquid, the cooking hardware 310, the substance being cooked, the like, or any combination thereof. The sensed temperature can be communicated to the controller 346 which can adjust the valve 330 in response thereto. By modulating the valve 330, the secondary line 328 can have variable gas flow to the junction 332 and sum line 334. An input 348 may correspond to a desired temperature and can allow the operator to communicate the desired temperature to the controller 346. By way of example, the input 348 can include a rotatable dial, a knob, a digital interface, or the like. In a particular embodiment, the input 348 can include a dial that is coaxially rotatable with the knob 308. By adjusting the input 348, the operator can effectively set the temperature at the gas burners 302 without requiring the operator to manually modulate the gas flow using the knob 308. In this regard, gas flow to the gas burners 302 may be controlled to achieve a precise temperature.

In certain instances, when operating in automatic operating mode, the primary line 324 of the secondary gas burner line 326 may be closed. For instance, the primary line 324 can be closed by the valve 318.

When operating in automatic operating mode, the secondary line 328 may operate as a modulated gas flow line. That is, gas flow rate supplied to the second gas burner 306 may be controlled by modulating gas flow through the valve 330. The valve 330 can modulate gas flow through the secondary line 328. Thus, gas flow through the sum line 334 may vary between no gas flow (e.g., when the valve 330 is closed) and a maximum gas flow rate provided by the maximum gas flow rate through the secondary line 328 when the valve 330 is fully open. Since the valve 330 is controlled by the controller 346 (i.e., the relative position of the valve 330 is adjusted by the controller 346), the controller 346 can modulate the gas flow to a flow rate between the off and a maximum gas flow rate. Thus, the controller 346 can affect temperature at the cooking hardware 310 between a minimum temperature and a maximum temperature. Since the controller 346 can operate in closed loop (i.e., receive temperature information from the sensor(s) 342 and adjust in response thereto), the controller 346 can effectively adjust the gas flow rate to maintain the temperature at the cooking hardware 310 at the desired temperature provided at the input 348.

Figure 5:
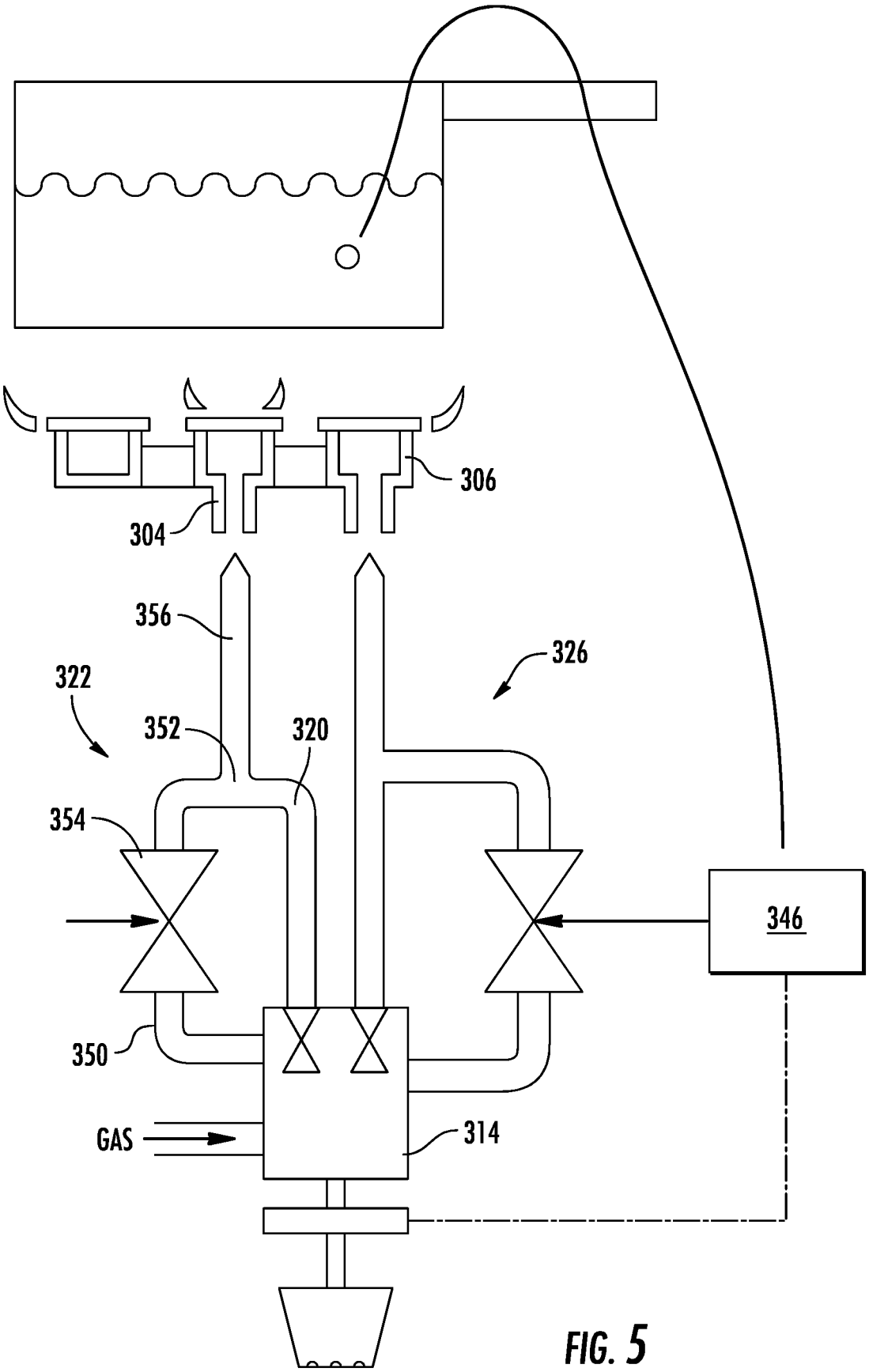
FIG. 5 is a schematic view of a control assembly in accordance with embodiments of the present disclosure.

In the embodiment depicted in FIGS. 3 and 4, the first gas burner 304 operates at a fixed gas flow rate and the second gas burner 306 operates at a variable gas flow rate when the cooking appliance is in automatic operating mode. Referring now to FIG. 5, in accordance with an embodiment, the control assembly 300 may permit selective control of both the first and second gas burners 304 and 306. The embodiment depicted in FIG. 5 is similar to the embodiment of FIGS. 3 and 4. However, instead of only including primary line 320, the first gas burner supply line 322 also includes a secondary line 350 which extends from the manifold 314 to a junction 352. A valve 354 (which can be referred to as a flow control valve) is disposed along the secondary line 350. The valve 354 is an electronically controllable valve. In an embodiment, the valve 354 may be controlled by the controller 346. In another embodiment, the valve 354 can be controlled by a separate controller (not illustrated). A sum line 356 may be disposed between the junction 352 and the first gas burner 304.

The first gas burner supply line 322 may operate similar to the second gas burner supply line 326 described in detail above. Use of an adjustable gas flow rate for the first gas burner supply line 322 may allow for further temperature control at the gas burners 302.

In a non-illustrated embodiment, the first gas burner supply line 322 can include primary and secondary supply lines 320 and 350 and the second gas burner supply line 322 can include only a primary line 324. This configuration is generally opposite to the one depicted in FIGS. 3 and 4.

FIGS. 6 to 9 illustrate an exemplary view of the knob 102, 308 in accordance with an embodiment. The knob 102, 308 may be generally rotatable about an axis 600. The input 216, 348 may also be rotatable about an axis. The axis of the input 216, 348 may be coaxial with the axis 600 of the knob 102, 308.

Figure 6:
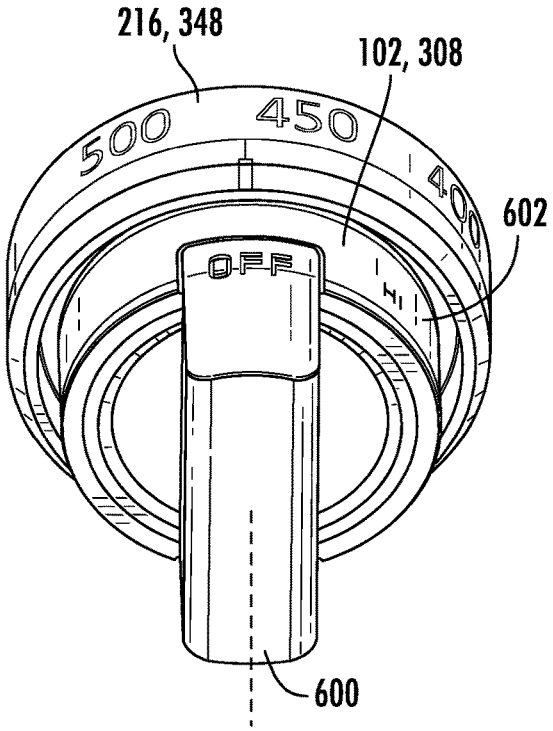
FIG. 6 is a perspective view of a knob for controlling the control assembly in accordance with embodiments of the present disclosure, as seen in a first position associated with a manual operating mode.
Figure 7:
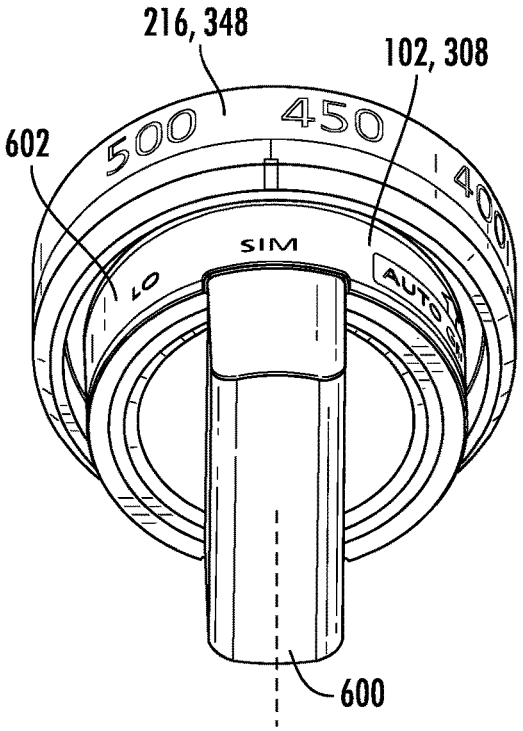
FIG. 7 is a perspective view of the knob for controlling the control assembly in accordance with embodiments of the present disclosure, as seen in a second position associated with the manual operating mode.
Figure 8:
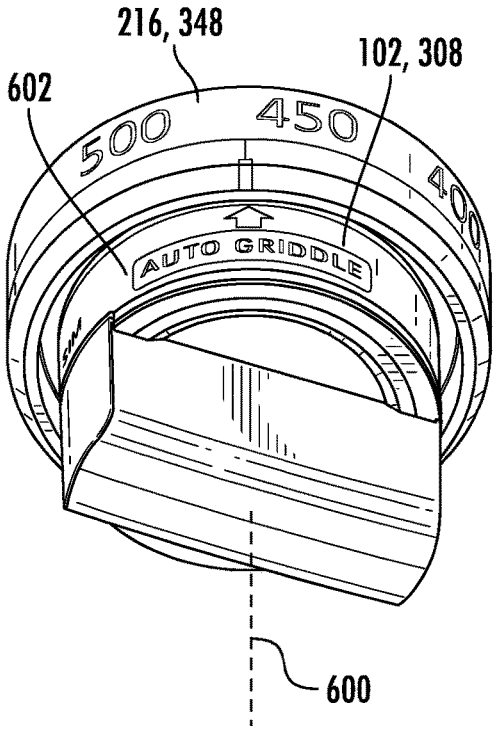
FIG. 8 is a perspective view of the knob for controlling the control assembly in accordance with embodiments of the present disclosure, as seen in a position associated with an automatic operating mode.
Figure 9:
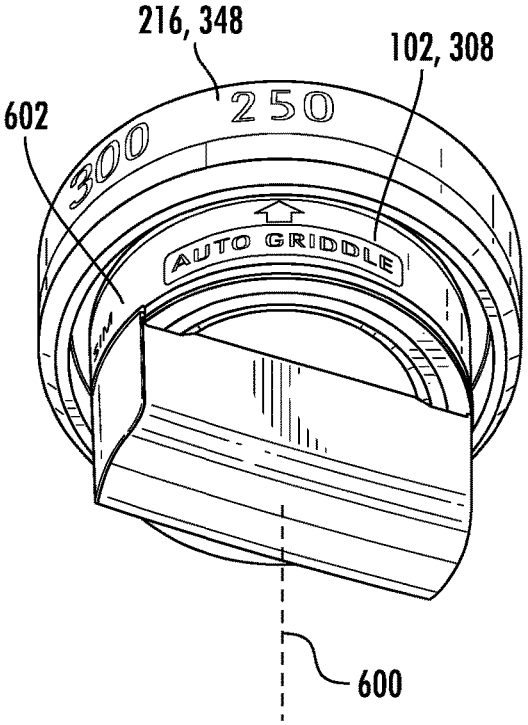
FIG. 9 is a perspective view of the knob for controlling the control assembly in accordance with embodiments of the present disclosure, as seen in a position associated with the automatic operating mode.

The knob 102, 308 can include indicia 602 which corresponds with a relative operating condition of the cooking appliance. For instance, the indicia 602 may correspond with a low temperature, marked as "LO", a high temperature, marked as "HI", a simmer temperature, marked as "SIM", and an automatic operating mode, marked as "AUTO GRIDDLE". The knob 102, 308 illustrated in FIG. 6 is disposed in the OFF position whereby the gas burners 200, 302 receive no gas flow. The knob 102, 308 illustrated in FIG. 7 is in a simmer mode whereby the cooktop appliance is operating in a manual mode at a simmer setting. The knob 102, 308 illustrated in FIG. 8 is in the automatic operating mode with the input 216, 348 set for approximately 465 degrees Fahrenheit. The knob 102, 308 illustrated in FIG. 9 is in the automatic operating mode with the input 216, 348 set for approximately 250 degrees Fahrenheit. The knob 102, 308 may be infinitely adjustable. That is, the knob 102, 308 may be adjustable to any location between rotational end points or stops. It should be understood that rotating the knob 102, 308 between the HI and SIM settings may allow for the operator to adjust the flame to any desired flame height. In certain instances, the cooktop appliance may include a tactile feedback when the knob 102, 308 is rotated from the manual operating mode to the automatic operating mode. The tactile feedback may include, for example, a detent or the like which causes a tactile indication when rotated past. It should be understood that the input 216, 348 may be set before or after the knob 102, 308 is set to the automatic operating mode. Moreover, the operator may adjust the input 216, 348 after the knob 102, 308 is in the automatic operating mode position, thereby allowing the operator to change the temperature at the gas burner.

FIGS. 10 to 13 illustrate schematic views of exemplary cooktop appliances in accordance with embodiments described herein. More particularly, FIGS. 10 to 13 illustrate control assemblies used to control gas flow to one or more gas burners.

As previously described, certain cooking operations, such as sous vide cooking, require application of precise temperature over long durations of time. Typically, the temperatures required to perform these cooking operations are below the threshold capability of gas stovetops. For instance, traditional stove tops (e.g., gas stove tops) are generally capable of producing a minimum of 600 BTU/hour of heat. This is well above the temperatures required to perform sous vide cooking at low temperatures (e.g., 130-160 degrees Fahrenheit). Thus, gas stove tops have traditionally not be utilized for these cooking operations. Instead, kitchens often have additional equipment exclusively utilized for sous vide. Systems and methods described herein may advantageously be capable of operating at low temperatures (i.e., below the minimum 600 BTU/hour threshold of traditional stovetop appliances). Thus, the systems and methods described herein can replace unnecessary kitchen equipment.

Figure 10:
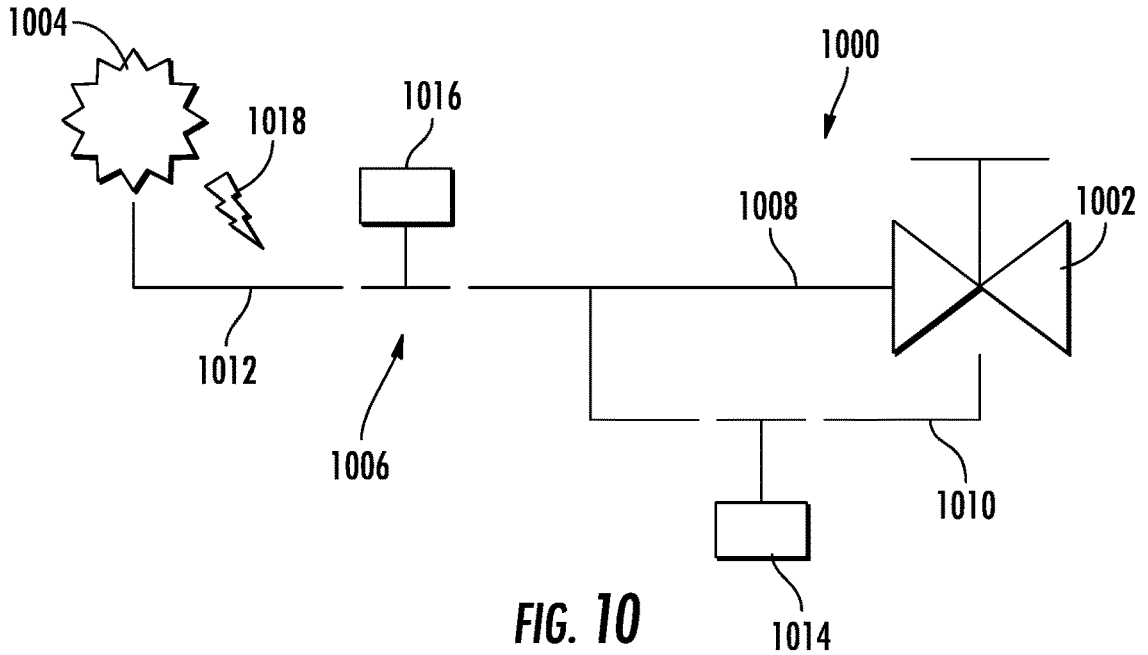
FIG. 10 is a schematic view of a cooktop appliance in accordance with embodiments of the present disclosure.

Referring initially to FIG. 10, a control assembly 1000 is depicted including a valve 1002 in fluid communication with a gas burner 1004 through a gas burner supply line 1006. The valve 1002 may be in fluid communication with a manifold, such as the exemplary manifolds 106, 314 described herein to receive gas. The valve 1002 can be a manually operated valve. The gas burner supply line 1006 can include a primary line 1008, a secondary line 1010, and a sum line 1012. A valve 1014 may be disposed along the secondary line 1010 to modulate gas flow through the secondary line 1010 when the control assembly 1000 is used in automatic operating mode. When the control assembly 1000 is operated in manual operating mode, the valve 1014 may be closed and the valve 1002 may be adjusted to modulate gas flow through the primary line 1008. A valve 1016 may be disposed on the sum line 1012 to regulate gas flow therethrough. A spark generator 1018 is disposed at the gas burner 1004. While not depicted, the control assembly 1000 can further include a control system which can monitor the temperature of the cooking hardware (not illustrated) at the gas burner 1004 and regulate the control assembly 1000 according to a desired temperature.

To maintain the temperature at the gas burner 1004 at the desired temperature it may be necessary periodically to terminate the flame at the gas burner 1004. Since the primary line 1008 is a non-modulated, minimum gas flow supply line in automatic operating mode, use of the valve 1016 may terminate gas flow to the gas burner 1004. The valve 1016 may be controlled by the control system. When the temperature at the cooking hardware exceeds a maximum threshold temperature, the control system can close the valve 1016 to stop the flame at the gas burner 1004. In certain instances, the valve 1016 can be modulated to positions between the open and closed positions. In other instances, the valve 1016 can operate as an on/off valve. When the temperature at the cooking hardware exceeds a minimum threshold temperature, the control system can open the valve 1016 to create gas flow to the gas burner 1004. The control system can further initiate the spark generator 1018 to generate a spark and ignite the flowing gas. This process can repeat successively over the duration of the cooking operation so as to maintain the temperature of the cooking hardware at a desired temperature (or at least within a range of acceptable tolerance).

Figure 11:
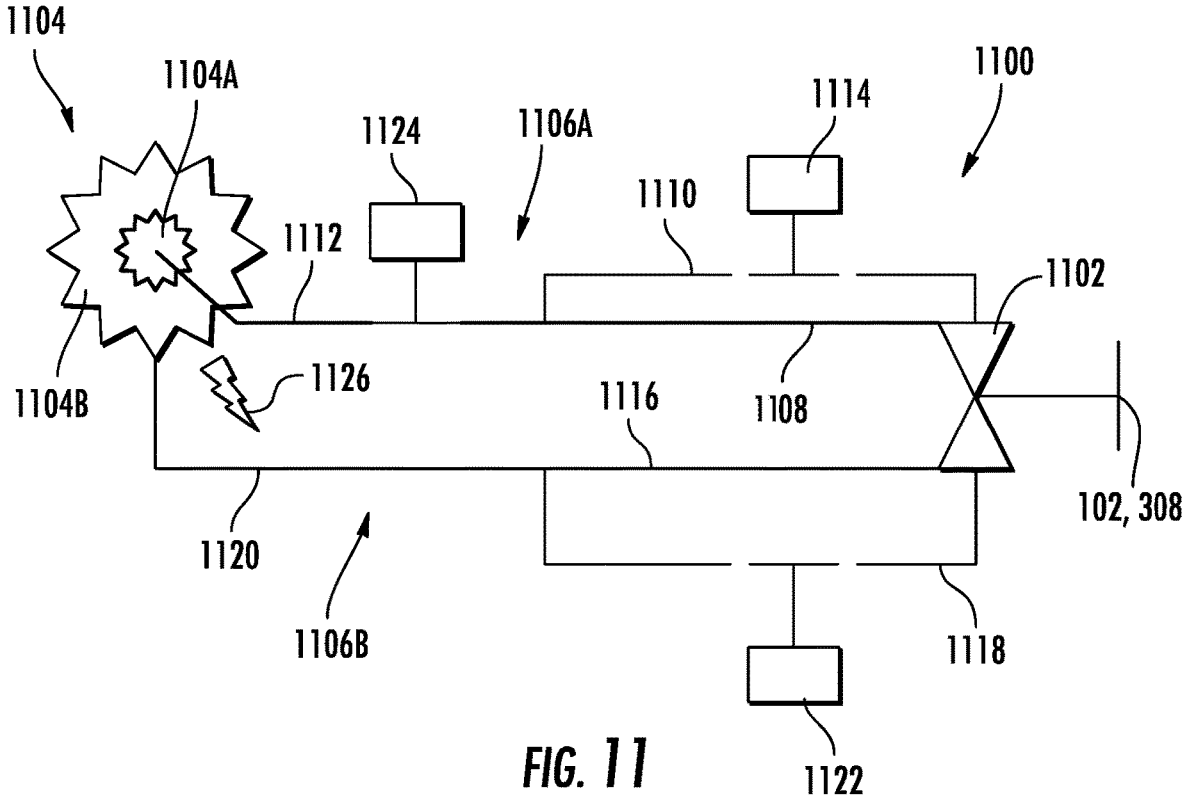
FIG. 11 is a schematic view of a cooktop appliance in accordance with embodiments of the present disclosure.

FIG. 11 illustrates a control assembly 1100 in accordance with another embodiment including a valve 1102 in fluid communication with a multi-burner gas burner 1104 through a gas burner supply line including a first gas burner supply line 1104A and a second gas burner supply line 1104B. The multi-burner gas burner 1104 includes a first gas burner 1104A and a second gas burner 1104B. The second gas burner 1104B extends around at least a portion of the circumference of the first gas burner 1104A. The first gas burner supply line 1104A can be in fluid communication with the first gas burner 1104A. The second gas burner supply line 1104B can be in fluid communication with the second gas burner 1104B.

In manual operating mode, the operator can control use of the first and second gas burners 1104A and 1104B using the valve 1102 which can be coupled with the aforementioned knob 102, 308 or a similar user interface. The valve 1102 may be in fluid communication with a manifold, such as the exemplary manifolds 106, 314 described herein to receive gas. The valve 1102 can be a manually operated valve. The first gas burner supply line 1106A can include a primary line 1108, a secondary line 1110, and a sum line 1112. A valve 1114 may be disposed along the secondary line 1110 to modulate gas flow through the secondary line 1110 when the control assembly 1100 is used in automatic operating mode. When the control assembly 1100 is operated in manual operating mode, the valve 1114 may be closed and the valve 1102 may be adjusted to modulate gas flow through the primary line 1108. The second gas burner supply line 1106B can include a primary line 1116, a secondary line 1118, and a sum line 1120. A valve 1122 may be disposed along the secondary line 1118 to modulate gas flow through the secondary line 1118 when the control assembly 1100 is used in automatic operating mode. When the control assembly 1100 is operated in manual operating mode, the valve 1122 may be closed and the valve 1102 may be adjusted to modulate gas flow through the primary line 1116.

A valve 1124 may be disposed on the sum line 1112 of the first gas burner supply line 1106A to regulate gas flow therethrough. A spark generator 1126 is disposed at the multi-burner gas burner 1104. The spark generator 1126 can include a single spark generator or a multi-spark generator with each spark generator of the multi-spark generator corresponding with a different one of the first and second gas burners 1104A or 1104B. While not depicted, the control assembly 1100 can further include a control system which can monitor the temperature of the cooking hardware (not illustrated) at the multi-burner gas burner 1104 and regulate the control assembly 1100 according to a desired temperature.

The control assembly 1100 depicted in FIG. 11 includes a valve 1124 only along the sum line 1112 and not the sum line 1120. To maintain the temperature at the multi-burner gas burner 1104 at the desired temperature it may be necessary periodically to terminate the flame at the multi-burner gas burner 1204. Since the primary line 1108 of the first gas burner supply line 1106A is a non-modulated, minimum gas flow supply line in automatic operating mode, use of the valve 1124 may terminate gas flow to the first gas burner 1104A. The valve 1124 may be controlled by the control system. When the temperature at the cooking hardware exceeds a maximum threshold temperature, the control system can close the valve 1124 to stop the flame at the first gas burner 1104A. In certain instances, the valve 1124 can be modulated to positions between the open and closed positions. In other instances, the valve 1124 can operate as an on/off valve. When the temperature at the cooking hardware exceeds a minimum threshold temperature, the control system can open the valve 1124 to create gas flow to the first gas burner 1104A. The control system can further initiate the spark generator 1126 to generate a spark and ignite the flowing gas. This process can repeat successively over the duration of the cooking operation so as to maintain the temperature of the cooking hardware at a desired temperature (or at least within a range of acceptable tolerance).

While not depicted, the second gas burner supply line 1106B may also, or alternatively, include a valve along the sum line 1120 to control the flow of gas to the multi-burner gas burner 1104. However, low temperature cooking is generally performed by only the first gas burner 1104A. That is, when low temperature output is required of the multi-burner gas burner 1104 (e.g., less than 500 BTU, such as less than 400 BTU, such as less than 300 BTU, such as less than 200 BTU, such as less than 100 BTU, such as less than 50 BTU, such as less than 25 BTU), it is typically only the first gas burner 1104A that has an active flame.

Figure 12:
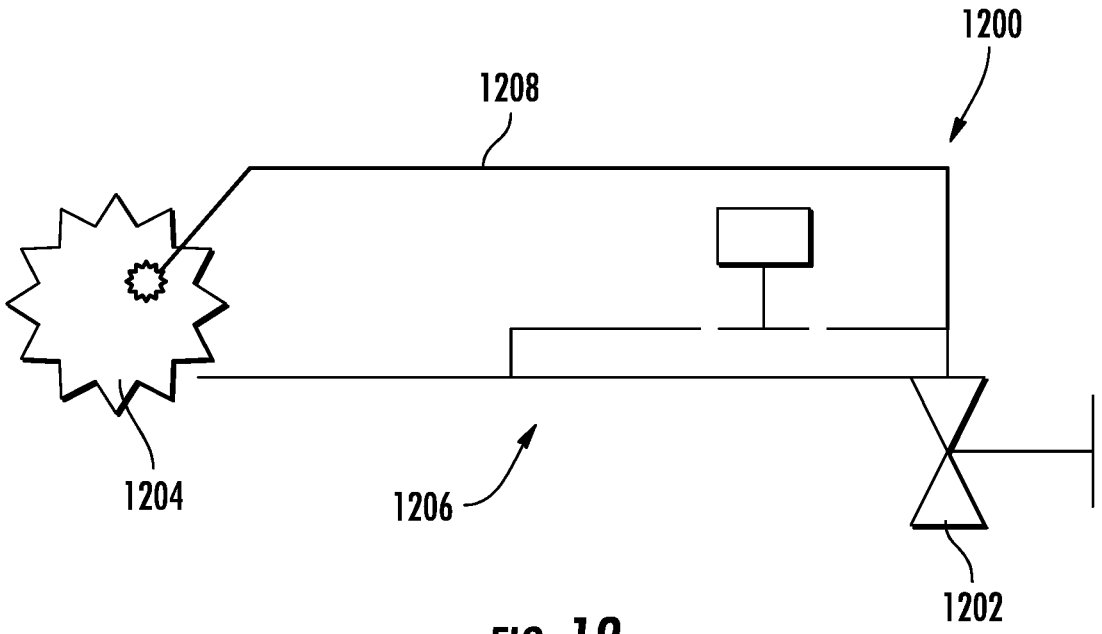
FIG. 12 is a schematic view of a cooktop appliance in accordance with embodiments of the present disclosure.

FIG. 12 illustrates a control assembly 1200 in accordance with another embodiment including a valve 1202 in fluid communication with a gas burner 1204 through a gas burner supply line 1206. The control assembly 1200 is similar to the control assembly 1000 depicted in the embodiment of FIG. 10, however, rather than include the spark generator 1018 (FIG. 10) the control assembly 1200 includes a pilot supply line 1208 which provides a pilot flame at the gas burner 1204 to reignite the gas burner 1204 when gas flow is restored following termination.

In certain instances, the pilot supply line 1208 depicted in FIG. 12 may be utilized during cooking operations. That is, as previously described, certain cooking operations require the use of low temperatures. When the gas burner supply line 1206 is off (i.e., no gas flows through the gas burner supply line 1206 to the gas burner 1204) the pilot supply line 1208 may be utilized to supply heat to the cooking hardware. In some instances, the pilot supply line 1208 can have a fixed (i.e., unmodulated) gas flow. In other instances, the pilot supply line 1208 can have a modulated gas flow.

Figure 13:
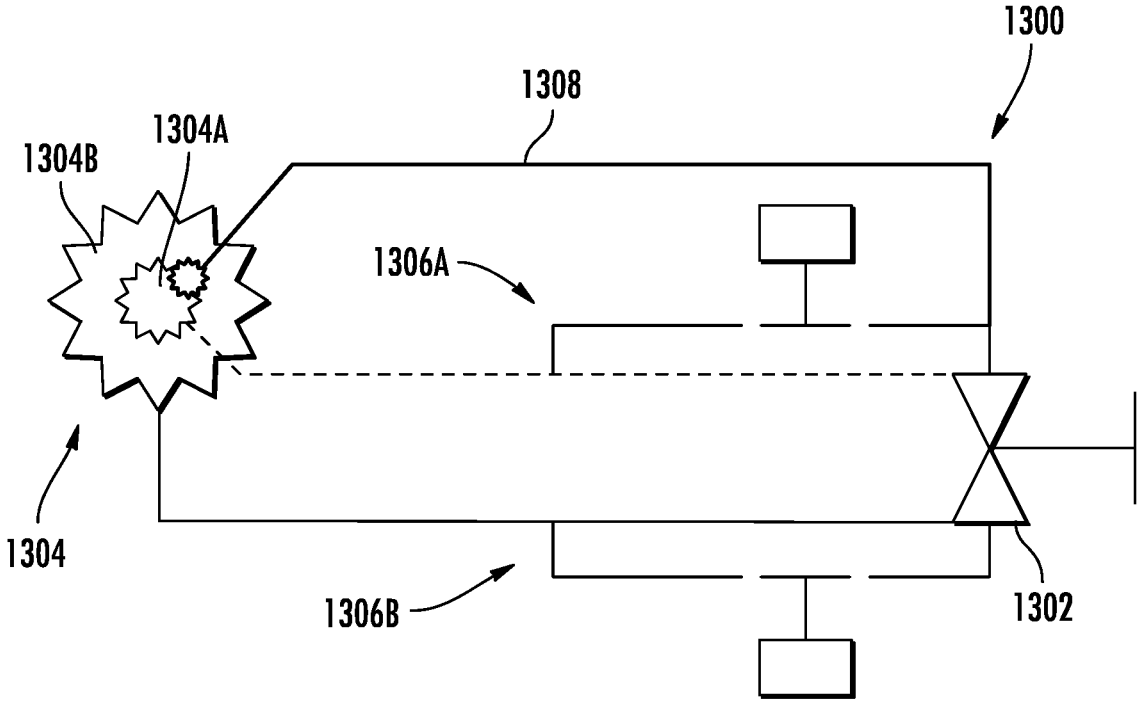
FIG. 13 is a schematic view of a cooktop appliance in accordance with embodiments of the present disclosure.

FIG. 13 illustrates a control assembly 1300 in accordance with another embodiment including a valve 1302 in fluid communication with a multi-burner gas burner 1304 through a gas burner supply line including a first gas burner supply line 1306A and a second gas burner supply line 1306B. The multi-burner gas burner 1304 includes a first gas burner 1304A and a second gas burner 1304B. The second gas burner 1304B extends around at least a portion of the circumference of the first gas burner 1304A. The first gas burner supply line 1306A can be in fluid communication with the first gas burner 1304A. The second gas burner supply line 1306B can be in fluid communication with the second gas burner 1304B.

The control assembly 1300 is similar to the control assembly 1100 depicted in the embodiment of FIG. 11, however, rather than relay on a spark generator 1126 (FIG. 11) the control assembly 1300 includes a pilot supply line 1308 which provides a flame at the multi-burner gas burner 1304 to reignite the multi-burner gas burner 1304 when gas flow is restored following termination.

Figure 14:
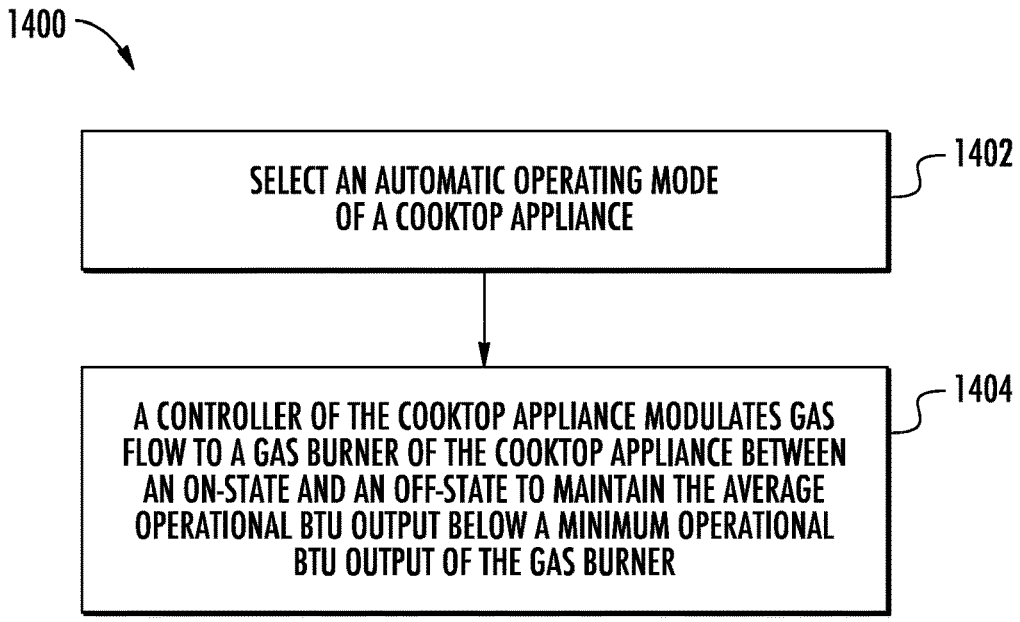
FIG. 14 is a flow chart of a method of using a gas burner of a cooktop appliance to heat a cooking implement at an average operational temperature below a minimum operational power output of the gas burner in accordance with embodiments of the present disclosure.

FIG. 14 illustrates a flow chart of a method 1400 of using a gas burner of a cooktop appliance to heat a cooking implement at an average operational temperature below a minimum operational power output of the gas burner. The method 1400 includes a step 1402 of selecting an automatic operating mode of the cooktop appliance. The step 1402 of selecting the automatic operating mode may be performed at a user selectable interface, such as a knob, used to adjust the cooktop appliance. The method 1400 further includes a step 1404 of a controller of the cooktop appliance modulating gas flow to the gas burner between an on-state and an off-state to maintain the average operational power output below the minimum operational power output of the gas burner. As used herein, average operational power output is a measure of total BTU output over a duration of time divided by the duration of time. Thus, for example, if the gas burner has an ON BTU output of 300 BTU/hour and is ON for half of the time, the average operational power output is approximately 150 BTU/hour. By modulating gas flow between the on-state and off-state (i.e., pulsing the gas burner), the actual temperature achievable at the gas burner can be less than the temperature which can be achieved when the gas burner is operated at a lowest ON state.

In certain instances, the method 1400 can further include a step of detecting a temperature corresponding to the gas burner (e.g., at the gas burner or a cooking implement thereon) and modulating gas flow. Modulating the gas flow can include modulating the gas flow to the on-state when the detected temperature is below a desired temperature and modulating the gas flow to the off-state when the detected temperature is above the desired temperature. The step 1404 of modulating the gas flow can be performed in view of the detected temperature.

In an embodiment, the cooktop appliance includes a pilot light. The pilot light can remain on at least when the cooktop appliance is being used. The step 1404 of modulating the gas burner to the on-state can be performed such that when gas flow to the gas burner resumes it is ignited by the pilot light. In another embodiment the cooktop appliance can include a spark generator configured to ignite the gas when the gas burner is modulated between an off-state and the on-state.

Figure 15:
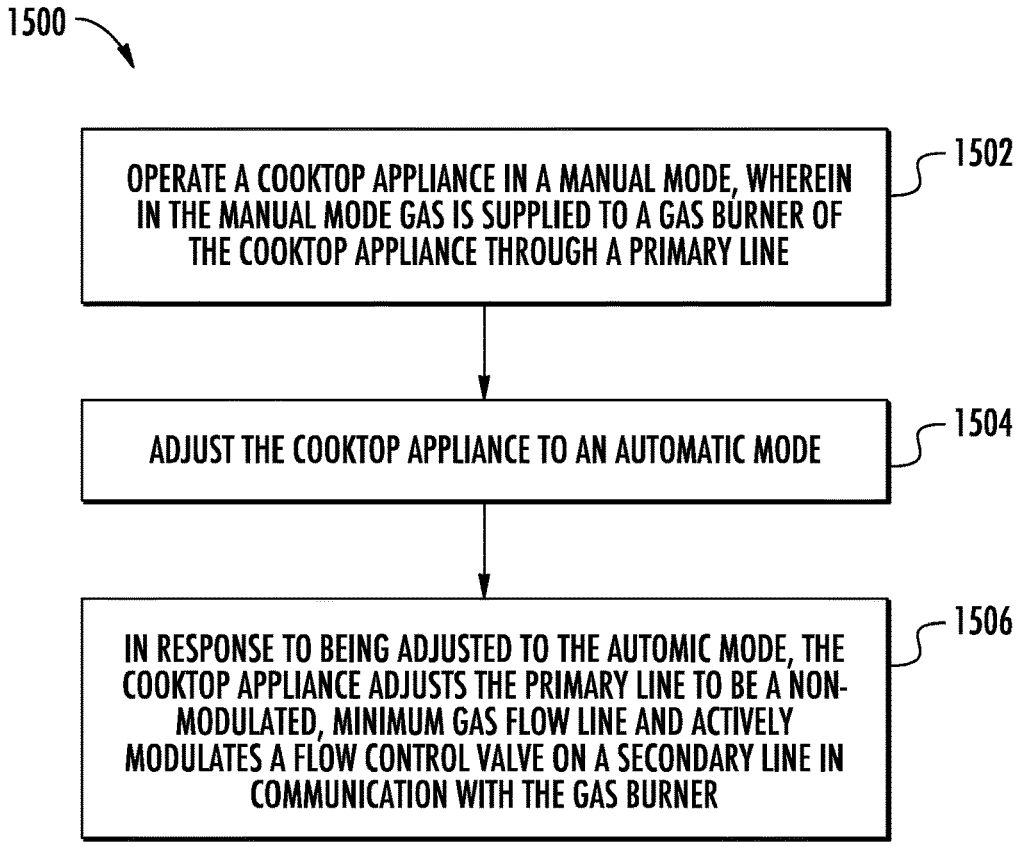
FIG. 15 is a flow chart of a method of using a cooktop appliance in accordance with embodiments of the present disclosure.

FIG. 15 illustrates a flow chart of a method 1500 of using a cooktop appliance in accordance with an exemplary embodiment. The method 1500 can include a step 1502 of operating the cooktop appliance in a manual mode. In the manual mode a gas is supplied to the gas burner of the cooktop appliance through a primary line. The method 1500 can further include a step 1504 of adjusting the cooktop appliance to an automatic mode. The step 1504 can be performed, for example, by rotating a user interface (e.g., a knob) from a range of manual operating mode positions to one or more automatic operating mode positions. The method 1500 can further include a step 1506 of in response to being adjusted to the automatic operating mode, the cooktop appliance adjusting the primary line to be a non-modulated, minimum gas flow line, and actively modulating a flow control valve on a secondary line in communication with the gas burner.

Systems and methods described herein can allow an operator to use a cooktop appliance in manual operating mode and automatic operating mode. The system can utilize closed loop feedback to maintain actual temperature at cooking hardware within a prescribed tolerance of a desired temperature (e.g., within +/−2 degrees Fahrenheit, such as within +/−1 degrees Fahrenheit, such as within +/−0.5 degrees Fahrenheit, such as within +/−0.25 degrees Fahrenheit, such as within +/−0.1 degrees Fahrenheit). In certain instances, the cooktop appliance can pulse the flame generated at the cooktop to maintain temperatures below minimum operating temperatures of the cooktop appliance. The cooktop appliance can utilize a spark generator or a gas supply pilot line to reignite the flame when flame is required and the gas burner does not have an active flame. In accordance with one or more embodiments, the cooktop appliance does not require incremental adjustments (e.g., compared to typical manually operated appliances) when converting the appliance between different fuel types, e.g., NG and LP, thus minimizing operator error during installation and setup and reducing operator time. These and other advantages of the systems and methods described herein are not found in traditional cooktop appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A cooktop appliance comprising:

a gas burner;

a manifold having a gas input;

a primary line extending between the manifold and the gas burner, wherein a gas flow rate in the primary line is controllable by a user selectable interface; and a secondary line extending between the manifold and the gas burner, wherein a gas flow rate in the secondary line is controllable by a flow control valve, and wherein the user selectable interface comprises a knob in mechanical communication with a manual valve disposed along the primary line to selectively control the gas flow rate in the primary line between a minimum and a maximum flow rate based on a position of the knob.

2. The cooktop appliance of claim 1, further comprising a control system comprising:

a sensor configured to detect a temperature corresponding to the gas burner; and a controller regulating the flow control valve in response to the detected temperature.

3. The cooktop appliance of claim 2, wherein the control system further comprises a user input configured to set a desired temperature, and wherein the controller controls the flow control valve in response to the desired temperature and the detected temperature.

4. The cooktop appliance of claim 3, wherein the user input comprises a rotatable dial, and wherein the rotatable dial is coaxial with the user selectable interface.

5. The cooktop appliance of claim 1, wherein the cooktop appliance is selectively operable in a manual mode or an automatic mode, wherein:

in the manual mode, the gas burner is controlled only by the primary line; and in the automatic mode, the gas burner is controlled by both the primary line and the secondary line.

6. The cooktop appliance of claim 5, wherein, in the automatic mode, the primary line operates as a non-modulated, minimum gas flow line and the secondary line operates as a modulated gas flow line.

7. The cooktop appliance of claim 1, wherein the primary and secondary lines are in fluid communication with one another at a junction, and wherein the junction is fluidly coupled to the gas burner through a sum line.

8. The cooktop appliance of claim 1, wherein the flow control valve is an electronically controlled valve.

9. A cooktop appliance configured to operate in a manual mode whereby a gas flow rate to a gas burner is controlled by a user selectable interface and an automatic mode whereby a gas flow rate to the gas burner is controlled by a flow control valve, and wherein the cooktop appliance is reconfigurable between different gas types by adjusting a single adjustment point, wherein the single adjustment point comprises an adjustment screw.

10. The cooktop appliance of claim 9, wherein the cooktop appliance further comprises:

a manifold having a gas input;

a primary line extending between the manifold and the gas burner, wherein a gas flow rate in the primary line is controllable by the user selectable interface; and a secondary line extending between the manifold and the gas burner, wherein a gas flow rate in the secondary line is controllable by the flow control valve, wherein adjusting the single adjustment point affects the primary line.

11. The cooktop appliance of claim 10, wherein:

in the manual mode, the gas burner is controlled only by the primary line; and in the automatic mode, the gas burner is controlled by both the primary line and the secondary line.

12. The cooktop appliance of claim 9, wherein the cooktop appliance further comprises a control system configured to control the gas burner when the cooktop appliance is in the automatic mode, and wherein the control system comprises:

a sensor configured to detect a temperature at corresponding to the gas burner; and a controller configured to regulate the flow control valve in response to the detected temperature.

13. The cooktop appliance of claim 9, wherein the flow control valve is an electronically controlled valve, and wherein the electronically controlled valve is only used to modulate the gas flow rate when the cooktop appliance is in the automatic mode.

14. A method of using a cooktop appliance comprising a gas burner, a manifold having a gas input, a primary line extending between the manifold and the gas burner, wherein a gas flow rate in the primary line is controllable by a user selectable interface, and a secondary line extending between the manifold and the gas burner, wherein a gas flow rate in the secondary line is controllable by a flow control valve, wherein the user selectable interface comprises a knob in mechanical communication with a manual valve disposed along the primary line to selectively control the gas flow rate in the primary line between a minimum and a maximum flow rate based on a position of the knob, and the method comprising:

operating the cooktop appliance in a manual mode wherein in the manual mode a gas is supplied to the gas burner of the cooktop appliance through the primary line;

adjusting the cooktop appliance to an automatic mode;

in response to being adjusted to the automatic mode, the cooktop appliance:

adjusting the primary line to be a non-modulated, minimum gas flow line; and actively modulating a flow control valve on a secondary line in communication with the gas burner.

15. The method of claim 14, wherein operating the cooktop appliance in the manual mode comprises adjusting a gas flow rate in the primary line using a user selectable interface.

16. The method of claim 15, wherein adjusting the cooktop appliance to the automatic mode is performed by adjusting the user selectable interface to a setting corresponding with the automatic mode.

17. The method of claim 14, wherein actively modulating the flow control valve comprises adjusting a gas flow rate through the secondary line in response to a desired temperature and a detected temperature of the gas burner.

18. The method of claim 14, further comprising detecting the presence of a cooking implement at the gas burner, and actively modulating the flow control valve only when the cooking implement is present.

19. The method of claim 14, wherein the cooktop appliance comprises a control system comprising a sensor configured to detect a temperature corresponding to the gas burner, and a controller configured to actively modulate the flow control valve in response to the detected temperature.

* * * * *